US007886459B2

(12) United States Patent
Ruess

(10) Patent No.: US 7,886,459 B2
(45) Date of Patent: Feb. 15, 2011

(54) APPARATUS FOR ASSISTING IN FLUID REMOVAL FROM FLUID STORAGE BLADDER AND THE LIKE

(75) Inventor: John Robert Ruess, Sandy, UT (US)

(73) Assignee: John R. Ruess, Farmington, UT (US)

( * ) Notice: Subject to any disclaimer, the term of this patent is extended or adjusted under 35 U.S.C. 154(b) by 257 days.

(21) Appl. No.: 11/716,312

(22) Filed: Mar. 8, 2007

(65) Prior Publication Data

US 2008/0216340 A1 Sep. 11, 2008

(51) Int. Cl.
*F26B 25/00* (2006.01)

(52) U.S. Cl. ..... 34/103; 34/106; 34/201; 34/239; 211/200; 211/41.6; 134/153; 134/6; 15/102; 15/97.1; 277/370

(58) Field of Classification Search ..... 34/103, 34/106, 201, 239; 211/200, 41.6; 134/153, 134/6; 15/102, 97.1; 277/370
See application file for complete search history.

(56) References Cited

U.S. PATENT DOCUMENTS 1,945,296 A * 1/1934 Klayman et al. ..... 34/281
2,239,572 A * 4/1941 Richa ..... 223/73
2,301,803 A * 11/1942 Davis ..... 210/771
2,317,924 A * 4/1943 Lendle ..... 223/67
2,574,848 A * 11/1951 Schroeder ..... 34/280
2,597,215 A * 5/1952 Wright et al. ..... 392/488
2,753,952 A * 7/1956 Anthony ..... 55/377
3,234,660 A * 2/1966 Williams et al. ..... 34/527
3,310,176 A * 3/1967 Ziherl et al. ..... 210/266
3,375,047 A * 3/1968 Townsend ..... 312/31
3,711,958 A * 1/1973 Lepage ..... 34/88
3,775,861 A * 12/1973 Waters et al. ..... 34/99

(Continued)

FOREIGN PATENT DOCUMENTS

DE 19714959 A1 * 10/1998

(Continued)

OTHER PUBLICATIONS

"Windpipe Hydration Pack Reservoir Dryer," Gear Trade the Gear Fanatic's Market, web page dated Feb. 15, 2007.

(Continued)

*Primary Examiner*—Stephen M. Gravini
(74) *Attorney, Agent, or Firm*—Eric Kohli

(57) ABSTRACT

A device and method for assisting in the removal of fluid, such as water, and related moisture from a bladder of a fluid storage device, such as a personal hydration pack or reservoir, is disclosed. The device has a three-dimensional structure or profile so that, when inserted within the bladder, the bladder is held in an open configuration or position, which allows any water or fluid to drain out and allows evaporation to the atmosphere of moisture to occur through the port of the bladder used to fill the device. In one form, the device has an insertion section having portions of elongated structure having a smaller size than the opening so that the insertion section can be fed into the bladder, and the overall insertion section has a profile larger than the opening so that the bladder is held open.

18 Claims, 5 Drawing Sheets

U.S. PATENT DOCUMENTS

| | | | | | |
|---|---|---|---|---|---|
| 3,832,789 | A | * | 9/1974 | Bartram | 34/99 |
| 3,986,268 | A | * | 10/1976 | Koppelman | 34/257 |
| 4,122,612 | A | * | 10/1978 | Mrofchak | 34/86 |
| 4,134,225 | A | | 1/1979 | Welch | |
| 4,138,036 | A | | 2/1979 | Bond | |
| 4,846,427 | A | | 7/1989 | Jones | |
| 4,972,604 | A | * | 11/1990 | Breckenridge | 34/487 |
| 5,047,123 | A | * | 9/1991 | Arvanitakis | 202/170 |
| 5,050,314 | A | * | 9/1991 | Breckenridge | 34/495 |
| 5,080,237 | A | * | 1/1992 | Hefner | 211/85.15 |
| 5,102,076 | A | | 4/1992 | North et al. | |
| 5,188,244 | A | * | 2/1993 | Hollstegge | 211/85.15 |
| 5,421,542 | A | * | 6/1995 | Crutcher | 248/95 |
| 5,641,137 | A | * | 6/1997 | Collier | 248/95 |
| 5,730,006 | A | * | 3/1998 | Conley | 68/6 |
| 6,061,924 | A | * | 5/2000 | Bolton et al. | 34/134 |
| 6,243,967 | B1 | * | 6/2001 | Dovolas | 34/103 |
| 6,329,139 | B1 | * | 12/2001 | Nova et al. | 506/30 |
| 6,495,058 | B1 | * | 12/2002 | Frankenbach et al. | 252/8.91 |
| 6,527,738 | B1 | * | 3/2003 | Jones et al. | 604/84 |
| 6,557,567 | B2 | | 5/2003 | Mood | |
| 6,640,982 | B1 | * | 11/2003 | Bjerke | 211/85.15 |
| 6,645,392 | B2 | * | 11/2003 | Frankenbach et al. | 252/8.91 |
| 6,701,947 | B1 | | 3/2004 | Ramos | |
| 6,802,136 | B2 | | 10/2004 | Merchant | |
| 6,916,305 | B2 | * | 7/2005 | Jones et al. | 604/84 |
| 6,983,754 | B1 | | 1/2006 | Anderson et al. | |
| 2003/0100860 | A1 | * | 5/2003 | Jones et al. | 604/84 |
| 2003/0106895 | A1 | | 6/2003 | Kalal | |
| 2003/0146405 | A1 | * | 8/2003 | Frankenbach et al. | 252/8.91 |
| 2004/0244216 | A1 | | 12/2004 | Poole | |
| 2006/0020240 | A1 | * | 1/2006 | Jones et al. | 604/84 |
| 2006/0112588 | A1 | * | 6/2006 | Ness et al. | 34/513 |
| 2007/0006482 | A1 | * | 1/2007 | Sabounjian | 34/442 |
| 2008/0120865 | A1 | * | 5/2008 | Smith | 34/239 |
| 2009/0110833 | A1 | * | 4/2009 | Wright et al. | 427/299 |
| 2009/0203840 | A1 | * | 8/2009 | Martin et al. | 525/50 |
| 2009/0287300 | A1 | * | 11/2009 | Dave et al. | 623/1.42 |

FOREIGN PATENT DOCUMENTS

| | | | | |
|---|---|---|---|---|
| DE | 19749557 | A1 | * | 5/1999 |
| EP | 152539 | A2 | * | 8/1985 |
| EP | 373005 | A2 | * | 6/1990 |
| EP | 1024220 | A2 | * | 8/2000 |
| GB | 2254599 | A | * | 10/1992 |
| WO | WO 2007058306 | A1 | * | 5/2007 |

OTHER PUBLICATIONS

"Sunlite Reservoir Dryer," Full Cycles Bike Shop, web page dated Feb. 15, 2007.
"Camelbak Reservoir Dryer," web page dated Feb. 15, 2007.

* cited by examiner

APPARATUS FOR ASSISTING IN FLUID REMOVAL FROM FLUID STORAGE BLADDER AND THE LIKE

FIELD OF THE INVENTION

The invention relates to fluid bladders and, in particular, to a device for assisting in fluid removal and/or drying of moisture from within the fluid bladder.

BACKGROUND

Currently, many devices are known that utilize a generally fluid/gas impermeable bladder. For instance, personal water reservoirs, hydration packs, or hydration bladders are utilized by outdoorsman, hikers, campers, and the like to transport water supplies while in places remote from trusted sources of potable water.

The concept of these packs is similar to that of a canteen, though the impermeable bladder is typically a soft and pliable (though relatively tough) plastic, in comparison to a canteen that is generally a rigid device made of metal (such as corrosion-resistant aluminum) or a polymeric material. Being somewhat soft, and often encased in a covering of nylon or the like, these devices are relatively comfortable when worn on a person's back, and the device collapses as it is drained, thus reducing its bulk.

Preferably, a port for delivering water (or other fluid, though preferably a potable fluid) to a person is located on the device. Often, the port is connected by a tube so that a person wearing the device merely needs to suck on the tube to draw fluid into their mouth. For a rigid canteen, such would be difficult due to the inability of the canteen to collapse, thus resulting in a negative pressure within the canteen fluid storage compartment. In some instances, the port may be located on a lower portion of the bladder so that gravity assists the water through the tube, and the bladder is simply free to collapse as it is drained.

One of the major problems with these devices is removing water and drying the bladder. First of all, it should be recognized that bacteria grows virtually wherever there is stagnant water. Accordingly, the bladder device should be dried before storing after a trip is done or the use of the bladder is, at least for the time being, no longer necessary or desired. For instance, someone may take the device to the beach for the day, and then want to put the device in a closet upon returning home. However, as long as water remains therein, there is the potential for growing bacteria, or mold, or other things considered unhealthy for humans. For instance, the bladder may develop black mold similar to what is witnessed underneath bathtub caulking.

It should be noted that bladders may be cleaned in various manners. For instance, mild detergent may be used prior to storage (or after) which may stave off or eliminate pathogens. However, it is still difficult to rinse the bladder of the detergent. The detergent, or other chemicals, may attack or degrade the polymeric material of the bladder over time. Boiling water may also have a negative effect on the polymeric material.

One of the best ways to eliminate or reduce the likelihood of pathogens within the bladder is simply to allow the interior of the device to completely air-dry in a well-ventilated area before putting in storage, and to do so in a manner that allows air flow through the bladder itself. Of course, it is also desirable to rinse the bladder interior before subsequent use.

However, the softness and desirable collapsibility of the bladder device lends to difficulties in air-drying the device.

That is, if one were to leave the bladder device for some period of time to dry, it is not unlike trying to keep a children's balloon open without the balloon being sealed. Of course, the bladder cannot be sealed during the drying, or else the evaporating moisture has no way of evacuating the bladder to the atmosphere.

Some devices currently exist for assisting in drying bladders. One type has a portion inserted into the bladder fill-hole. An electric motor forces air through this portion into the bladder, the air serving to dry the interior as the air is forced out from the fill hole and from the drink tube. This is a multi-component, expensive, electric based system.

Another type includes a side portions that are pulled rearwardly to collapse the device for insertion, and then the side portions return to a natural position once inserted within the bladder. However, this is a two-dimensional device that is not effective at holding the bladder open, particular at the edges of the interior space.

Accordingly, there has been a need for an improved method and system for drying bladders of personal fluid reservoirs.

SUMMARY

In accordance with an aspect, a device for drying a personal fluid reservoir is disclosed. A section of the drying device may be inserted within the reservoir, or bladder, that substantially holds the device in an open position filled with air and in fluid communicating with the atmosphere. The drying device may have a second section for supporting the drying device and the bladder during drying and/or storage.

In one form, the inserted section may be rigid. The rigid section may have a size greater than an opening to the interior of the bladder. The rigid section may be shaped to allow passage of the rigid section into the opening by portions. The portions may be elongated portions extending in a plurality of directions. The rigid section may be shifted and advanced relative to the bladder, such as by rotating or screwing into the bladder, so as to be fed into the opening. The shifting of the rigid section may be linear, or it may be somewhat circular or rotational so as to feed the portions into the opening. The portions may be portions of a helix, or a spiral, a three-dimensional zig-zag, a combination thereof, or the like. In some forms, the inserted section has a rounded terminus or leading portion for initial insertion.

In another aspect, a method of drying a bladder is disclosed. The steps of the method may include inserting a section of a drying device within the bladder to allow air access to substantially the entirety of the interior surface of the bladder. The steps of the method may include inserting a rounded leading portion of the inserted section into an opening of the bladder, and feeding other portions of the inserted section to hold the bladder interior open to air. This step may include shifting the inserted section relative to the bladder in a direction other than the advancing direction to feed different portions of the inserted section through the opening. This step may include rotating the bladder relative to the inserted section while advancing the inserted section into the opening of the bladder.

According, a device for assisting in removal and moisture from a fluid reservoir having an interior cavity and an opening for access the interior cavity is disclosed, the device including an insertion section receivable within the fluid reservoir for holding the interior cavity in an open position. The device may further include a support section connected to the insertion section, the support section adapted to position the insertion section and the fluid reservoir located thereon away from a ground surface or like. The support section may include an upwardly extending portion positioning the opening of the fluid reservoir above the ground surface, and laterally extending portions for supporting the device and bladder thereon. The insertion section may extend in a first direction from the support section, the first direction having at least a horizontal component, and the laterally extending portions may extend at least in part towards the first direction. The laterally extending portions may include a first leg being angled from the horizontal component, and a second leg being angled from the horizontal component in an opposite manner to the first leg. The device may include a rearwardly extending leg extending from the support section in a direction generally opposite the horizontal component of the direction of the insertion portion.

The insertion section may extend in a direction having a horizontal component leading away from the support section, and may be angled upwardly from the support section so that fluid or moisture within the fluid reservoir drains towards the support section.

The insertion section is preferably three-dimensional so that, when received within the fluid reservoir, portions of the fluid reservoir are held apart to permit fluid flow and air passage within the fluid reservoir.

The insertion section may include portions of elongated structure, the insertion section having a profile greater than the opening of the fluid reservoir, and the elongated structure having a profile smaller than the opening of the fluid reservoir so that the insertion section may be fed into the opening. The insertion section may generally comprise circular portions. The insertion section may generally comprise a series of coils. The coils may have varying sizes.

The insertion section may have a leading tip adapted to assist feeding of the insertion section within the fluid reservoir. The leading tip may include a rounded surface.

In another aspect, a drying device for a bladder of a personal hydration device for storing and carrying potable water is disclosed, the drying device including an insertion section receivable within the bladder so that portions of the bladder are held away from other portions of the bladder, thereby permitting fluid flow from the bladder through an opening thereof, the insertion section receivable within the bladder via the bladder opening, the insertion section having a profile larger than the opening and including at least elongated portions, the elongated portions having a profile smaller than the opening so that the elongated portions may be sequentially received into the opening. The drying device may further include a support section, wherein the insertion section is supported by the support section so that the insertion section supports the bladder thereon at an angle relative to a horizontal direction to allow water from the bladder to flow toward the opening through which the insertion section is received by the bladder. The elongated portions may include a series of coils, and the insertion section may be receivable within the bladder by rotating and advancing the insertion and bladder relative to each other.

In another aspect, a method of assisting in removal of fluid or moisture from an interior of a fluid reservoir, the method including the step of sequentially feeding portions of a three-dimensional device within the fluid reservoir through an opening thereof to hold portions of the fluid reservoir apart, and including the step of supporting the fluid reservoir in a position to allow fluid or moisture therein to drain towards the fluid reservoir opening. The step of sequentially feeding may include rotating and advancing the fluid reservoir and device relative to each other.

DETAILED DESCRIPTION

Figure 1:
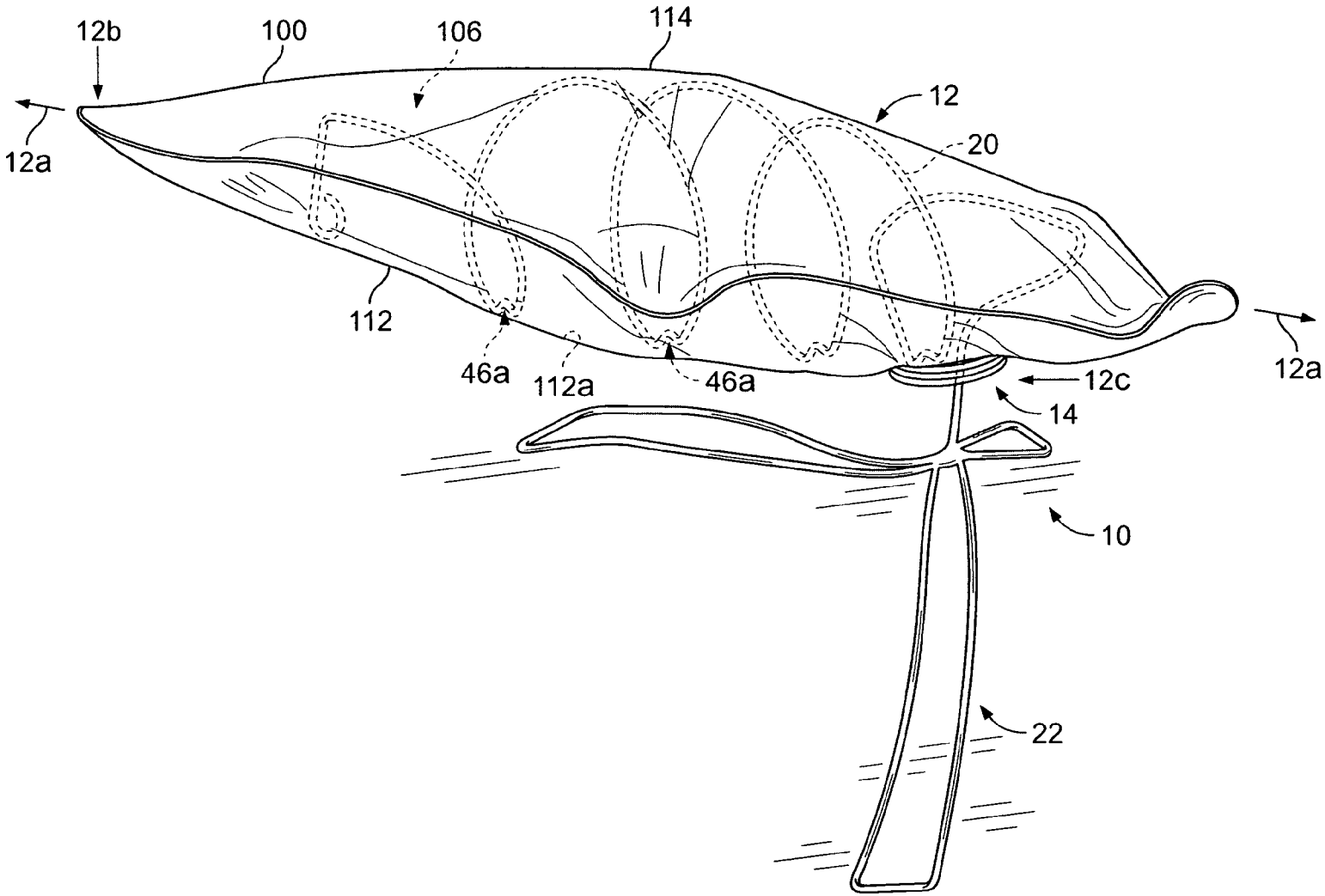
FIG. 1 is a perspective view of a bladder for containing fluid and a drying device for assisting in drying of and removal of water from an interior surface and volume of the bladder, the drying device having an insertion section shown in phantom received within the bladder and a support section supporting the insertion section.
Figure 5:
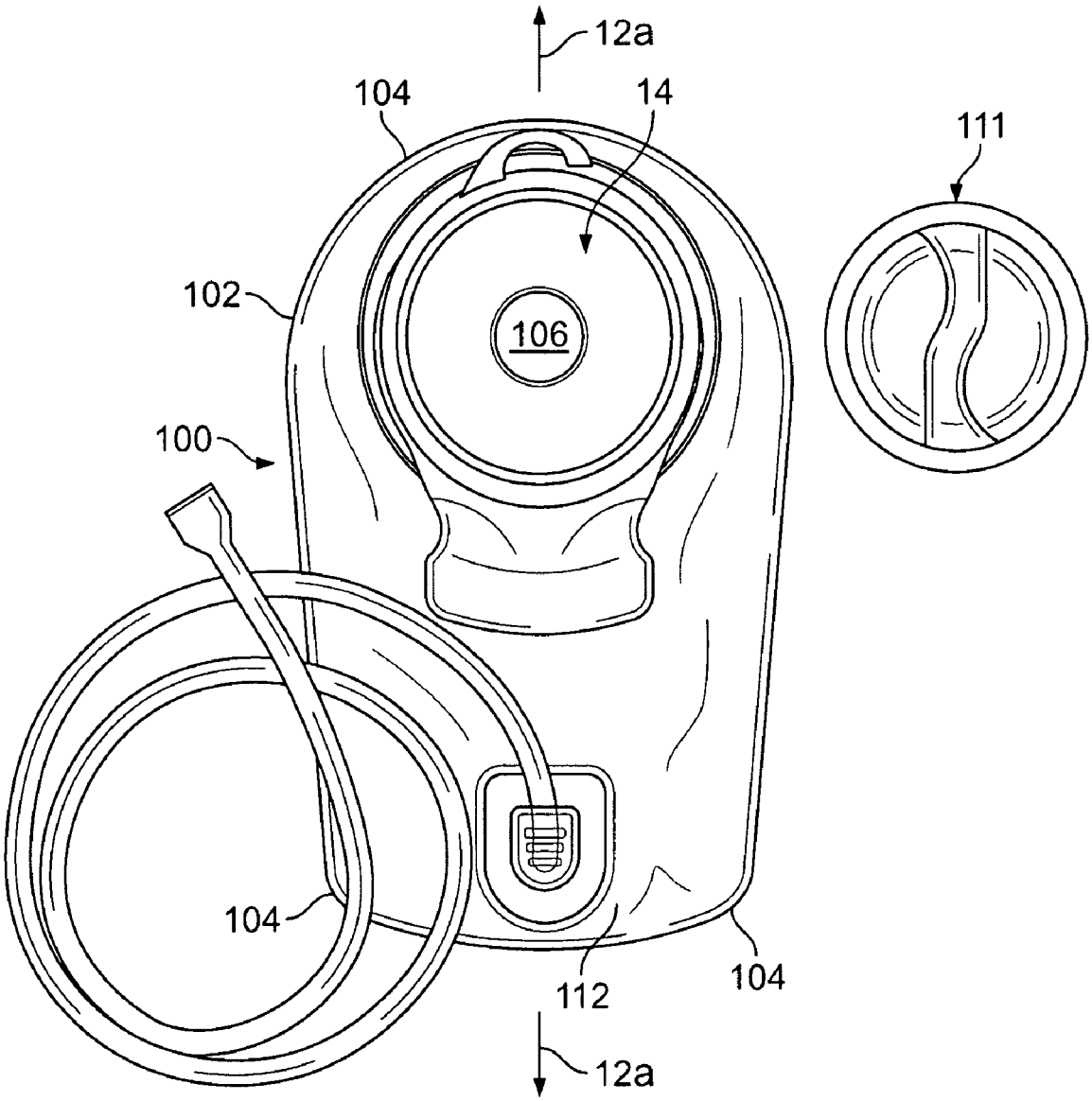
FIG. 5 is a bottom side elevational view of the bladder of FIG. 1 showing a port therein providing access to the interior of the bladder from the exterior thereof.

Referring initially to FIGS. 1 and 5, a device for assisting in removal and drying of moisture from a fluid reservoir, referred to herein as a drying device 10, is depicted with a fluid reservoir or bladder 12 shown in a drying configuration with the drying device 10. As can be seen, the drying device 10 has a three-dimensional profile so that various portions of the bladder 12, when received therewithin, are held apart so that fluid such as water or moisture is allowed to either drain from the bladder 12 or is able to evaporate to the atmosphere outside of the bladder 12.

As seen in FIG. 5, the bladder 12 generally includes a reservoir body 100 which may have a variety of shapes, the present shape being generally somewhat rectangular 102 with rounded portions or corners 104 when empty and flat. The reservoir body 100 defines an interior cavity 106 when held open, which may be done by air, fluid, the drying device 10, or a combination thereof. The reservoir body 100 includes first and second opposed side panels 112 and 114. A closure 111 is removably fitted with a port 14 that allows access from the outside of the bladder 12, such as the atmosphere, to the interior cavity 106. A fluid source (not shown) such as a spigot or water faucet may be used to fill the cavity 106 with fluid via the port 14, and the port 14 may be used to drain the cavity 106 when preparing the bladder 12 for storage and is used to insert a drying device insertion section 20 into the bladder 12 for such storage preparation.

Figure 2:
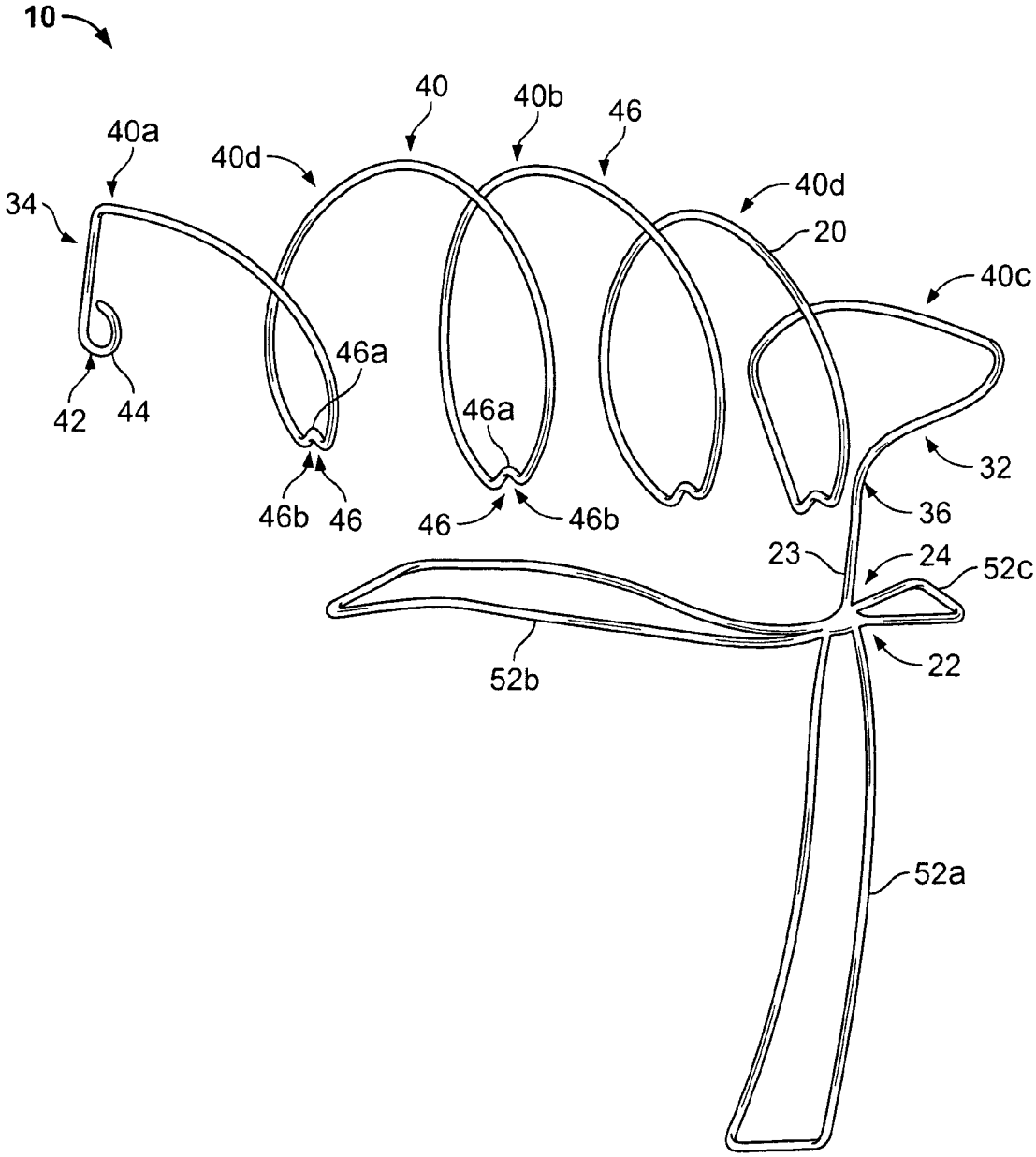
FIG. 2 is a perspective view similar to FIG. 1 showing the drying device with the bladder removed therefrom.
Figure 3:
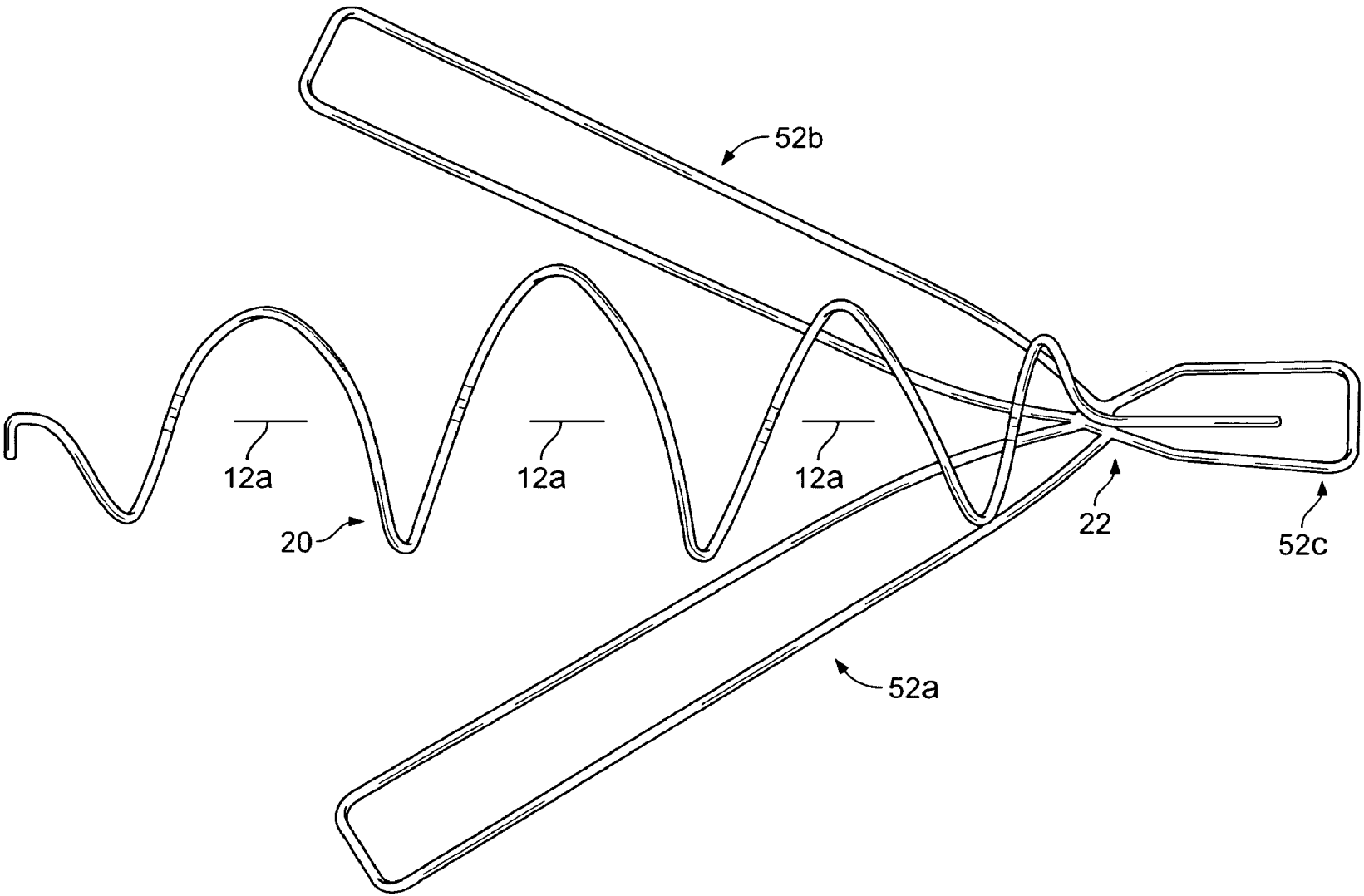
FIG. 3 is a top plan view of the drying device of FIG. 1.
Figure 4:
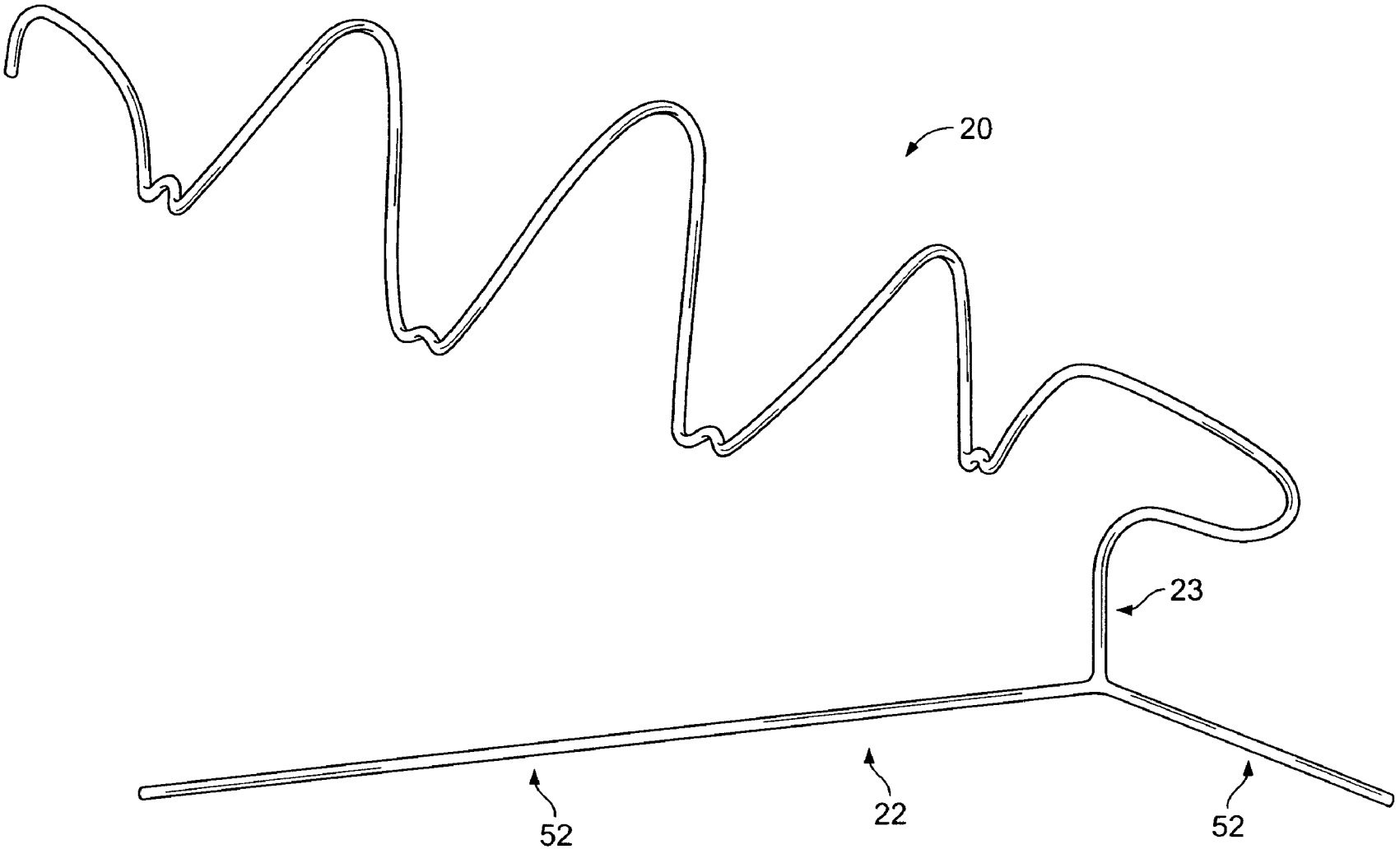
FIG. 4 is a side elevation view of the drying device of FIG. 1.

With reference to FIGS. 2-4, the drying device 10 principally includes an insertion section 20 that is fed into the bladder 12 for drying thereof and a support section 22 connected with the insertion section 20 to support the insertion section 20 and a bladder 12 located therearound. An extension 23 is formed between the insertion section 20 and the support section 22. The insertion section 20 preferably is angled somewhat upwardly from a joint 24 between the extension 23 and the support section 22. In this manner, the bladder 12 located around the insertion section 20 is also angled so that gravity assists any water within the bladder 12 in flowing towards the port 14 (FIGS. 1 and 5) in the bladder 12 through which the water can flow. The insertion section 20 has a proximal end 32 located closely to a connection or joint 36 between the insertion section 20 and the extension 23, and has a distal or leading end 34, the leading end 34 being an initial portion inserted into the port 14 when the insertion section 20 is guided or fed into the bladder 12.

The insertion section 20 is preferably three-dimensional, as noted above. That is, while a generally two-dimensional device may be constructed which reaches the extents of the interior of the bladder 12, a three-dimensional insertion section 20 holds apart various portions of the bladder 12, such as side panels 112 and 114, so that the natural adhesion and cohesion of the water molecules between each other and with the surface of the interior of the bladder 12 do not prevent or impede the water from migrating towards the port 14, and so that air has access to the extents of the interior of the bladder 12 so whatever moisture that does not migrate toward the port 14 is minimal enough that air is able to assist in evaporating such moisture. It should be noted that the terms water and moisture used herein are for convenience and are meant to encompass not only potable drinking supplies by also any other fluid that may be stored in such a device.

In the preferred embodiment, the insertion section 20 is a circular coil or helix of elongated structure, such as wire, for instance. More precisely, the insertion section 20 includes a series of coils 40 that vary from a first small coil 40*a* located at the leading end 34, a center coil 40*b* approximately midway along the insertion section, and a second small coil 40*c* located at the proximal end 32. Between the first small coil 40*a* and the center coil 40*b*, as well as between the center coil 40*b* and the second small coil 40*c*, are coils 40*d* of progressively varying intermediate size. The size difference or variance between each adjacent coil 40 of the coils 40*a*-40*d* may be linear, or may be non-linear. Preferably, the insertion section 20 is slightly smaller in its center (proximate to and/or including the center coil 40*c* or a portion thereof) than for portions immediately adjacent thereto.

The terminal or leading end 34 of the insertion section 20 further includes an insertion tip 42 for assisting in feeding of the insertion section 20 into the bladder 12. In the present embodiment, the insertion tip 42 is shaped as a bent portion so that the insertion tip 42 has a leading rounded surface 44. When the insertion section 20 is fed into the bladder 12, the rounded surface 44 resists catching on the soft material of the bladder 12 and allows the insertion section 20 to be easily fed into the bladder 12.

The insertion section 20 is designed so that the insertion tip 42 may be fed through the port 14 and into the cavity 106, and the rest of the insertion section 20 may be subsequently fed thereinto. In the embodiment shown as a helix or coil, the bladder 12 and insertion section 20 may be rotated (and advanced) relative to each other so that the coils 40 that are generally larger than the port 14 may be sequentially fed into the opening. In should be noted that a series of straight portions, arranged in a three-dimensional zig-zag configuration, would also be suitable, though perhaps less desirable. To assist this feeding of the insertion section 20 into the bladder 12, it may be desirable to have one or more of the insertion section 20, support section 22, and extension 23 releasably connected at one or more of the joints 24, 36. This would allow one to simply rotate the bladder 12 in one direction with one hand while rotating the insertion section 20 with a second hand to feed the insertion section 20 through the port 14 and into the bladder 12, while also advancing the bladder 12 and insertion section 20 towards each other, without the support section 22 hindering this motion.

The extension 23 an upwardly extending and preferably generally vertical section. The support section 22 also includes supporting legs 52 laterally extending from the extension 23. As shown in FIG. 2, the legs 52 may be somewhat curved, while in FIG. 4 the legs 52 are generally straight. The extension 50 holds the insertion section 20 and the bladder 12 thereon at a clearance above a surface level, which the legs 52 rest on, so that fluid or moisture draining therefrom are able to escape and drain away. The legs 52 extend outwardly from the extension 23 and generally in the direction of the insertion section 20 so that the legs 52 support the mass (and resulting torque or moment arm) of the bladder 12 and the insertion section 20. More specifically, a left leg 52*a* extends generally in the same horizontal direction as the insertion section, though angled or offset to the left of the direction of the insertion section 20, while a right leg 52*b* extends similarly though angled to the right of the direction of the insertion section 20. A rear leg 52*c* extends rearwardly of the extension 23, generally extending opposite to a horizontal component of the direction the insertion section 20 extends from the extension 23.

When the insertion section 20 is located within the bladder 12, any water or moisture therein desirably drains from the bladder 12 through the port 14. The bladder 12 arranged around the insertion section 20 has a centerline 12*a* (FIG. 1) which extends from an upper point 12*b* towards a lower point 12*c* at the port 14. As should be apparent, if the coils 40 were simply circular, a bottom portion 46 thereof would likely rest against the interior surface 112*a* of the bottom panel 112 of the bladder 12. Though generally extending laterally within the bladder 12, each coil 40 of the insertion section 20 is angled with respect to the centerline 12*a*. As water flows towards the port 14, the water would follow the coil 40 at a lateral angle, away from the centerline 12*a*, when it flows into contact with the coil bottom portion 46 resting against the bladder interior surface 112*a*. Thus, coils 40 can serve to impeded flow of water towards and through the port 14.

To reduce the restriction or impedance of this flow, a section 46*a* of the bottom portion 46 of each coil 40 has an offset or curvilinear notch 46*b* therein, as best seen in FIG. 2. As any lateral section of the bladder 12 tends to have a lowest point along the centerline 12*a* (due to gravity and due to the greatest extent of the bottom portion 46 of each coil 40 being located abreast of the centerline 12*a*), much of the fluid flow would be directed along the centerline 12*a*. Therefore, the coil notches 46*b* allow this flow to pass relatively unimpeded. Furthermore, each coil 40 is provided with such notch 46*b* and the notches 46*b* are aligned with each other so as to form a relatively straight path along the centerline 12*a* and towards the port 14.

In one form, the insertion section 20 is collapsible. For instance, the insertion section 20 may be compressed in its longitudinal direction so that the coils 40 are compressed to a generally flat arrangement. This may be done for storage purposes, for instance, of the insertion section 20.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. A fluid evacuation device for evacuating fluid from a fluid reservoir having a flexible interior cavity, comprising:

an insertion member comprising an insertion tip and an insertion body, said insertion body having an exterior circumference larger than an exterior circumference of said insertion tip, wherein said insertion tip comprises means for said insertion body to be rotatably and substantially rigidly inserted into an opening in the flexible interior cavity of the fluid reservoir, and said insertion body comprising helical coils constructed of a substantially rigid material, said helical coils substantially rigidly spaced apart from each other, said helical coils shaped to substantially conform to a substantially expanded shape of the flexible interior cavity of the fluid reservoir and to non-collapsably hold the flexible interior cavity spaced apart when said insertion body is rotatably and substantially rigidly inserted into the flexible interior cavity through the opening whereby said device facilitates the drying of fluid in the flexible interior cavity of the fluid reservoir.

2. The fluid evacuation device of claim 1, wherein said means in said insertion tip for said insertion body to be rigidly inserted into the opening in the flexible cavity comprises a bent portion to form a rounded surface.

3. The fluid evacuation device of claim 1, further comprising a support member rigidly connected to said insertion member.

4. The fluid evacuation device of claim 1, wherein at least two of said helical coils vary in size.

5. The fluid evacuation device of claim 4, wherein all of said helical coils vary in size.

6. The fluid evacuation device of claim 1, wherein each helical coil has a notch.

7. The fluid evacuation device of claim 6, wherein each notch in each helical coil is positioned curvilinearly with respect to each other.

8. The fluid evacuation device of claim 3, wherein said support member is designed to support and hold said insertion member on a substantially horizontal surface whereby the fluid reservoir is positioned at an angle relative to said horizontal surface with the opening substantially facing said horizontal surface.

9. The fluid evacuation device of claim 1, wherein said helical coils are constructed of a continuous substantially rigid material.

10. A method of evacuating fluid from a fluid reservoir having a flexible interior cavity, comprising:

rotatably inserting an insertion member in the flexible interior cavity of the fluid reservoir, wherein said insertion member comprises an insertion tip and an insertion body, said insertion body having an exterior circumference larger than an exterior circumference of said insertion tip, wherein said insertion tip comprises means for said insertion body to be rotatably and substantially rigidly inserted into an opening in the flexible interior cavity of the fluid reservoir, and said insertion body comprising helical coils constructed of a substantially rigid material, said helical coils substantially rigidly spaced apart from each other, said helical coils shaped to substantially conform to a substantially expanded shape of the flexible interior cavity of the fluid reservoir and to non-collapsably hold the flexible interior cavity spaced apart when said insertion body is rotatably and substantially rigidly inserted into the flexible interior cavity through the opening whereby said device facilitates the drying of fluid in the flexible interior cavity of the fluid reservoir.

11. The method of evacuating fluid from a fluid reservoir having a flexible interior cavity of claim 10, wherein said means in said insertion tip for said insertion body to be rigidly inserted into the opening in the flexible cavity comprises a bent portion to form a rounded surface.

12. The method of evacuating fluid from a fluid reservoir having a flexible interior cavity of claim 10, further comprising a support member rigidly connected to said insertion member.

13. The method of evacuating fluid from a fluid reservoir having a flexible interior cavity of claim 10, wherein at least two of said helical coils vary in size.

14. The method of evacuating fluid from a fluid reservoir having a flexible interior cavity of claim 13, wherein all of said helical coils vary in size.

15. The method of evacuating fluid from a fluid reservoir having a flexible interior cavity of claim 10, wherein each helical coil has a notch.

16. The method of evacuating fluid from a fluid reservoir having a flexible interior cavity of claim 15, wherein each notch in each helical coil is positioned curvilinearly with respect to each other.

17. The method of evacuating fluid from a fluid reservoir having a flexible interior cavity of claim 12, wherein said support member is designed to support and hold said insertion member on a substantially horizontal surface whereby the fluid reservoir is positioned at an angle relative to said horizontal surface with the opening substantially facing said horizontal surface.

18. The method of evacuating fluid from a fluid reservoir having a flexible interior cavity of claim 10, wherein said helical coils are constructed of a continuous substantially rigid material.

* * * * *